US005722770A

United States Patent [19]

Douglas

[11] Patent Number: 5,722,770

[45] Date of Patent: Mar. 3, 1998

[54] LIGHT FIXTURE HAVING POSITION-ORIENTED LAMP

[75] Inventor: Cary L. Douglas, San Marcos, Tex.

[73] Assignee: The Genlyte Group Incorporated, Union, N.J.

[21] Appl. No.: 748,176

[22] Filed: Nov. 12, 1996

[51] Int. Cl.[6] ..... F21V 19/00

[52] U.S. Cl. ..... 362/285; 362/263; 362/287; 362/429

[58] Field of Search ..... 362/263, 261, 362/285, 287, 289, 427, 429

[56] References Cited

U.S. PATENT DOCUMENTS 4,173,037 10/1979 Henderson, Jr. et al. .
4,893,224 1/1990 Tinley ..... 362/287
5,016,150 5/1991 Gordin et al. .
5,111,371 5/1992 Nielson ..... 362/261

*Primary Examiner*—Stephen F. Husar
*Attorney, Agent, or Firm*—Vaden, Eickenroht & Thompson, L.L.P.

[57] ABSTRACT

A light fixture for setting the optimum position of a position-oriented lamp, independently of the fixture position, includes a housing for holding the position-oriented lamp and having an opening through which light emanates from the lamp. Means is releasably connected to the housing for rotating the position-oriented lamp relative to the housing and securing the lamp to the housing when the lamp has been rotated to its optimum position. Means is mounted to the rotating and securing means for indicating when the position-oriented lamp has been rotated to its optimum position, so that the lamp can be so positioned without having visual access to it.

2 Claims, 1 Drawing Sheet

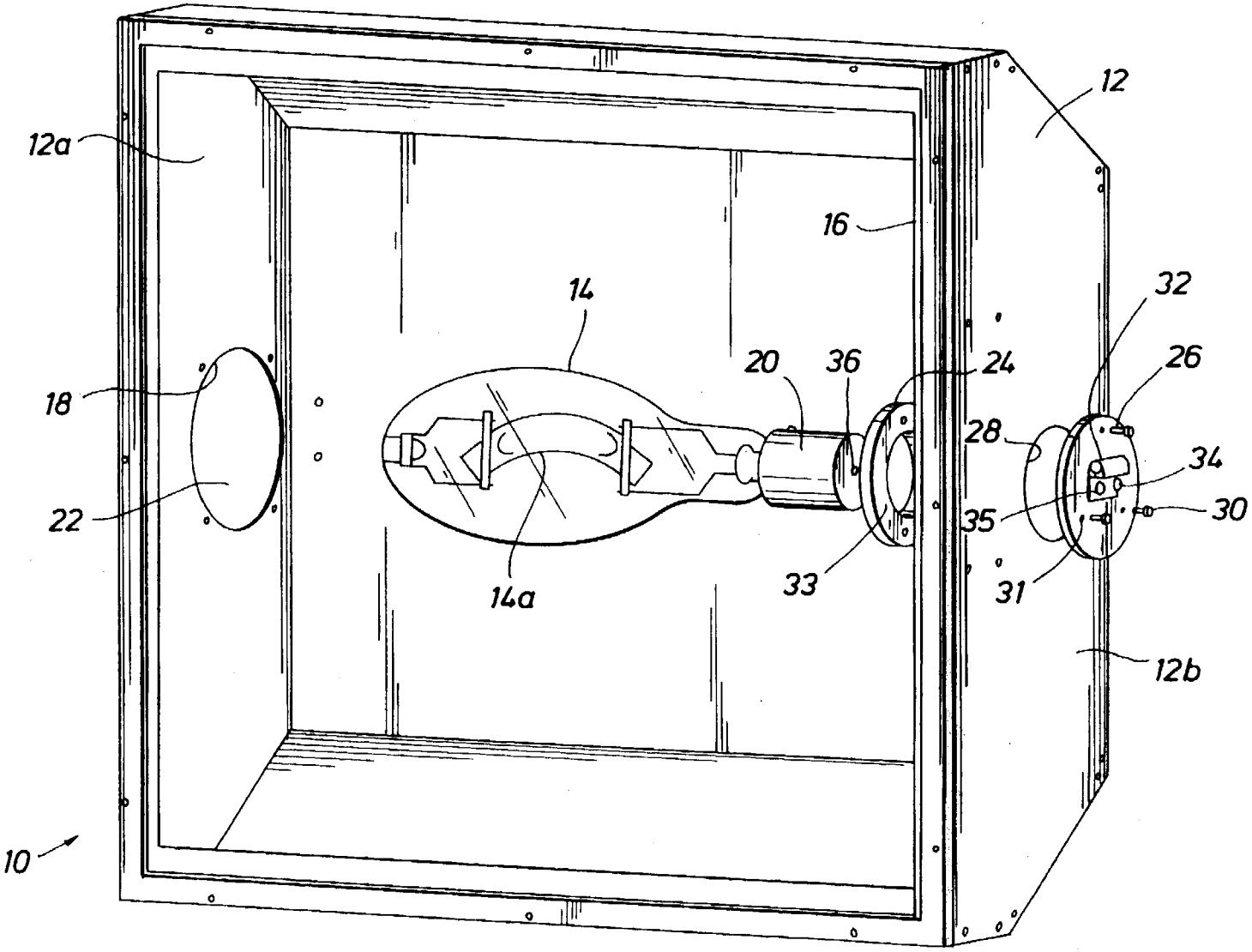
12
12a
12b
14
14a
16
18
20
22
24
26
28
30
31
32
33
34
35
36
10

LIGHT FIXTURE HAVING POSITION-ORIENTED LAMP

BACKGROUND OF THE INVENTION

1. Field of the Invention

The present invention relates to light fixtures having position-oriented lamps.

2. The Related Art

The use of position-oriented lamps, such as position-oriented mogul base lamps (POMs), in light fixtures is well known. These lamps are so named because their lumen output is optimized by the positioning, or orientation, of the lamp's discharge arc with respect to "nadir," i.e., a point straight down in the sense of a gravitational vector.

Position-oriented lamps are typically mounted within a light fixture, and the fixture is installed in desirable applications such as, e.g., above catwalks beneath the roof of a large structure. These light fixtures are mounted for rotation about the longitudinal, or socket axis of the lamp permitting the fixture to be rotated to direct the light emanating from the lamp in a particular direction. The problem with such mounting methods is that the positioning of the lamp, and the lamp's discharge arc, relative to nadir will be affected by the installation and rotation of the fixture itself. Thus, position-oriented lamps cannot be properly oriented for optimum illumination until after the fixture containing the lamp has been secured in its position.

It is therefore an object of the present invention to provide an improved light fixture capable of adjusting the position of a position-oriented lamp for optimum lumen output after the fixture has been installed.

U.S. Pat. No. 4,893,224 describes an emergency lighting fixture having a reflector and lens combination that support a lamp and are movable relative to the fixture housing to adjust the position of the lamp. However, the lamp is only rotatable to a limited extent, and the axis about which the lamp is rotated is offset from the lamp due to the ratchet/pawl mechanism utilized by the fixture. Thus, it is difficult to precisely position the lamp for optimum orientation because there is no rotation through the socket axis of the lamp. As such, the fixture described in the '224 patent is not suitable for use with a position-oriented lamp.

Similarly, U.S. Pat. No. 4,713,737 provides for rotation of a lamp within a fixture housing about two independent axes, but neither is the socket axis of the lamp. Thus, a position-oriented lamp could not be precisely and easily controlled by this fixture to deliver its optimum lumen capacity to a desired target.

U.S. Pat. No. 5,325,281 discloses an adjustable lighting system that permits a lamp within a fixture housing to be rotated about two independent axes in order to direct the light emanating from the lamp as desired. However, this disclosure requires that the housing provide access to the lamp through the light-emanating opening in the housing, and further requires access to the light emanating opening to adjust the direction of the lamp. No mention of a position-oriented lamp is made by this disclosure, presumably because the typical application of such lamps prohibits easy access to the light-emanating opening in light fixtures containing position-oriented lamps.

It is therefore a further object of the present invention to provide an improved light fixture wherein the position of a position-oriented lamp can be easily adjusted from a location opposite the light emanating opening of the fixture housing, and that permits the use of a sealed lens or other designs not having clear access to the lamp through this opening.

It is a further object to provide such a light fixture wherein the position of the lamp may be set without having visual access to the lamp.

SUMMARY

The objects described above, as well as other objects and advantages are achieved by a light fixture that includes a housing for holding a position-oriented lamp and having an opening through which light emanates from the lamp. Means is releasably connected to the housing for rotating the position-oriented lamp relative to the housing and securing the lamp to the housing when the lamp has been rotated to its optimum position. Means is mounted to the rotating and securing means for indicating when the position-oriented lamp has been rotated to its optimum position, so that the lamp can be so positioned without having visual access to it.

BRIEF DESCRIPTION OF THE DRAWINGS

In the drawings, wherein like reference characters are used throughout to describe like parts:

The FIGURE is a perspective view of a light fixture in accordance with the present invention.

DETAILED DESCRIPTION OF THE PREFERRED EMBODIMENT

The figure illustrates light fixture 10 that includes housing 12 for holding high intensity discharge (HID), position-oriented mogul (POM) base lamp 14 and having lens-covered opening 16 through which light emanates from the lamp. Lamp 14 is adapted for horizontal mounting, and includes arc tube 14*a* through which the lamp's discharge arc will be produced when the lamp is properly positioned. Lamp 14 is designed to produce an upwardly bowed discharge arc when arc tube 14*a* is pointed upwardly away from "nadir," a point straight down from lamp 14 along a gravitational vector that passes through the lamp. In this position, which is shown in the figure, lamp 14 achieves its optimum efficiency. Improper positioning of lamp 14 and arc tube 14*a* relative to nadir will result in inefficient performance and possibly cause lamp 14 to "burn out" prematurely. Thus, the orientation of the lamp relative to nadir is critical, and must be maintained independently of the orientation of housing 12.

Housing 12 is also provided with opening 18 in wall 12*a* through which lamp 14 may be replaced or lamp socket 20 may be serviced without removal of the housing lens. Opening 18 is normally covered by plate 22 which is screwed to side wall 12*a* of housing 12.

Means in the form of contact ring 24 and positioning plate 26 are releasably connected through opening 28 to wall 12*b* for rotating position-oriented lamp 14 relative to the housing, and for securing the lamp to the housing when the lamp has been rotated to its optimum position. Screws 30 are fitted through holes 31 in plate 26 and pass through opening 28 to engage complementary holes 33 in ring 24. Screws 34 are fitted through holes formed in level plate 35 and positioning plate 26 about the center of plate 26 for engaging holes 36 in lamp socket 20, connecting plate 26 to lamp 14 through socket 20. This connection is achieved by passing socket 20 through the opening in ring 24 so that the socket is in contact with the inner face of plate 26. In this fashion, a releasable "sandwich" assembly including plate 26 and ring 24 is formed about wall 12*b* to hold lamp 14 within housing 12.

Thus, screws 30 are rotated counter-clockwise to release and open the assembly whereby plate 26 is released from wall 12*b*. Screws 30 are not rotated so far as to disengage plate 26 from ring 24, but are merely rotated a few turns to permit the release of the plate from wall 12*b*. This action permits lamp 14 to be rotated relative to housing 12 simply by rotating plate 26. The rotation of plate 26 will apply a torque to socket 20 through screws 34 that rotates lamp 14.

Means in the form of bubble level 32 is mounted to level plate 35 and positioning plate 26 for indicating when position-oriented lamp 14 has been rotated by plate 26 to its optimum position, as shown in the figure. The relationship between level 32 and lamp 14 is fixed independently of fixture housing 12 so that the lamp can be so positioned to provide optimum illumination without the installer having visual access to the lamp, as is often the case in remote installations such as on catwalks and the like. Thus, lamp 14 is equipped with "keyed" threads (not shown) which ensure that the lamp is always screwed into socket 20 up to a constant angular position, whereby the relationship between lamp 14 and bubble level 32 is fixed.

High performance illumination is optimized by favorably positioning the discharge arc of lamp 14 with respect to nadir. Thus, when fixture 10 is aimed by rotating it throughout a range of angles relative to an illumination target, the lamp-rotating and securing means described above permit the positional relationship of the lamp's discharge arc with respect to nadir to be optimized and maintained regardless of the fixture orientation. The result is an increase in the efficiency and useful life of lamp 14.

Once the optimum position of lamp 14 is reached, as indicated by the level position of bubble level 32, screws 30 are rotated clockwise to close the assembly of plate 26 and ring 24 upon wall 12*b*. This action secures the assembly to the wall and fixes the position of lamp 14 to provide optimum illumination from light fixture 10.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense. For example, those skilled in the art will appreciate that level 32 can be replaced by a gravity-controlled pointer that always aims straight downwardly so as to indicate the optimum directional lumen output of lamp 14 to an installer without the necessity of the installer having visual access to the lamp.

What is claimed is:

1. A light fixture for setting the position of a position-oriented arc lamp for optimum lumen output independently of the fixture position, comprising:

a housing for holding a position-oriented arc lamp and having an opening through which light emanates from the arc lamp;

rotating and securing means releasably connected to said housing for rotating the position-oriented arc lamp relative to said housing and securing the arc lamp to said housing when the arc lamp has been rotated to its optimum lumen output position; and means mounted to said rotating and securing means for indicating when the position-oriented arc lamp has been rotated to its optimum lumen output position.

2. The light fixture of claim 1, wherein said indicating means comprises a bubble level affixed to said rotating and securing means.

* * * * *